US005215439A

United States Patent [19]

Jansen et al.

[11] Patent Number: 5,215,439

[45] Date of Patent: Jun. 1, 1993

[54] ARBITRARY HUB FOR CENTRIFUGAL IMPELLERS

[75] Inventors: Willem Jansen, Weston; Melvin Platt, Holliston, both of Mass.

[73] Assignee: Northern Research & Engineering Corp., Woburn, Mass.

[21] Appl. No.: 935,667

[22] Filed: Aug. 25, 1992

Related U.S. Application Data

[63] Continuation of Ser. No. 641,432, Jan. 15, 1991, abandoned.

[51] Int. Cl.[5] ..... F04D 29/28

[52] U.S. Cl. ..... 416/183; 416/188; 416/235; 416/236 R; 415/914

[58] Field of Search ..... 416/179, 182, 183, 185, 416/186, 188, 223 B, 235, 236 R; 415/914

[56] References Cited

U.S. PATENT DOCUMENTS

| | | | |
|---|---|---|---|
| 2,735,612 | 2/1956 | Hausmann | 415/914 |
| 2,918,254 | 12/1959 | Hausamann | 415/914 |
| 3,481,531 | 12/1969 | MacArthur et al. . | |
| 3,927,952 | 12/1975 | Kirby . | |
| 4,188,169 | 1/1980 | Mowill . | |
| 4,420,288 | 12/1983 | Bischoff | 415/914 |
| 4,465,433 | 8/1984 | Bischoff | 415/914 |

FOREIGN PATENT DOCUMENTS

| | | | |
|---|---|---|---|
| 999826 | 2/1952 | France | 416/185 |
| 69211 | 4/1985 | Japan | 416/183 |
| 1059217 | 12/1983 | U.S.S.R. | 416/183 |
| 944166 | 12/1963 | United Kingdom | 416/235 |
| 90/02265 | 3/1990 | World Int. Prop. O. | 416/183 |

*Primary Examiner*—Edward K. Look
*Assistant Examiner*—James A. Larson
*Attorney, Agent, or Firm*—Michael H. Minns

[57] ABSTRACT

A centrifugal impeller includes a hub formed about an axis of rotation with a plurality of substantially radially extending blades affixed to the hub, each blade having a suction surface, and a pressure surface formed on the adjacent blade facing the suction surface. The blades have a height being measured in a radial direction from the hub. A portion of the hub, having a hub configuration, extends between the pressure surface and the suction surface. An imaginary plane extending in a direction normal to the axis of rotation is used to define a cross-sectional view of the impeller. A first and a second concentric circle are formed in the plane with the center of the concentric circles being the axis of rotation. The first circle passes through a point on the hub located closest to the axis of rotation. The second circle has a radius greater than the first circle by an amount equal to five percent of the blade height, wherein a portion of the hub extends outside of the second circle. This configuration has, on occasion, improved flow characteristics for centrifugal impellers over impellers having concentric hub configurations.

9 Claims, 4 Drawing Sheets

ARBITRARY HUB FOR CENTRIFUGAL IMPELLERS

This application is a continuation of application Ser. No. 641,432, filed Jan. 15, 1991 abandoned.

BACKGROUND OF THE INVENTION

This invention relates generally to centrifugal impellers and more particularly to arbitrary hub designs for centrifugal impellers.

In the prior art centrifugal impellers, each point on the hub which is located in the same plane normal to the axis of rotation is approximately the same distance from the axis of rotation. This configuration is referred to as concentric or non arbitrary hub design or contour.

The non arbitrary hub designs often are not the optimal design considering the compressibility of fluids, nonuniform flow across the passage between the impeller blades, resistance of the impeller to loads placed thereupon and the fact that the impeller rotates in one direction. For these reasons, among others, the impeller with a non arbitrary hub configuration often will not be the most efficient, or will limit the range of rotational speeds at which the impeller may operate.

The foregoing illustrates limitations known to exist in present centrifugal impeller designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a centrifugal impeller comprising a hub formed about an axis of rotation with a plurality of substantially radially extending blades affixed to the hub, each blade having a suction surface, a pressure surface formed on the adjacent blade facing the suction surface. The blades have a height being measured in a radial direction from the hub. A portion of the hub, having a hub configuration, extends between the pressure surface and the suction surface. An imaginary plane extending in a direction normal to the axis of rotation is used to define a cross-sectional view of the impeller. A first and a second concentric circle are formed in the plane with the center of the concentric circles being the axis of rotation. The first circle passes through a point on the hub located closest to the axis of rotation. The second circle has a radius greater than the first circle by an amount equal to five percent of said blade height, wherein a portion of the hub extends outside of the second circle.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
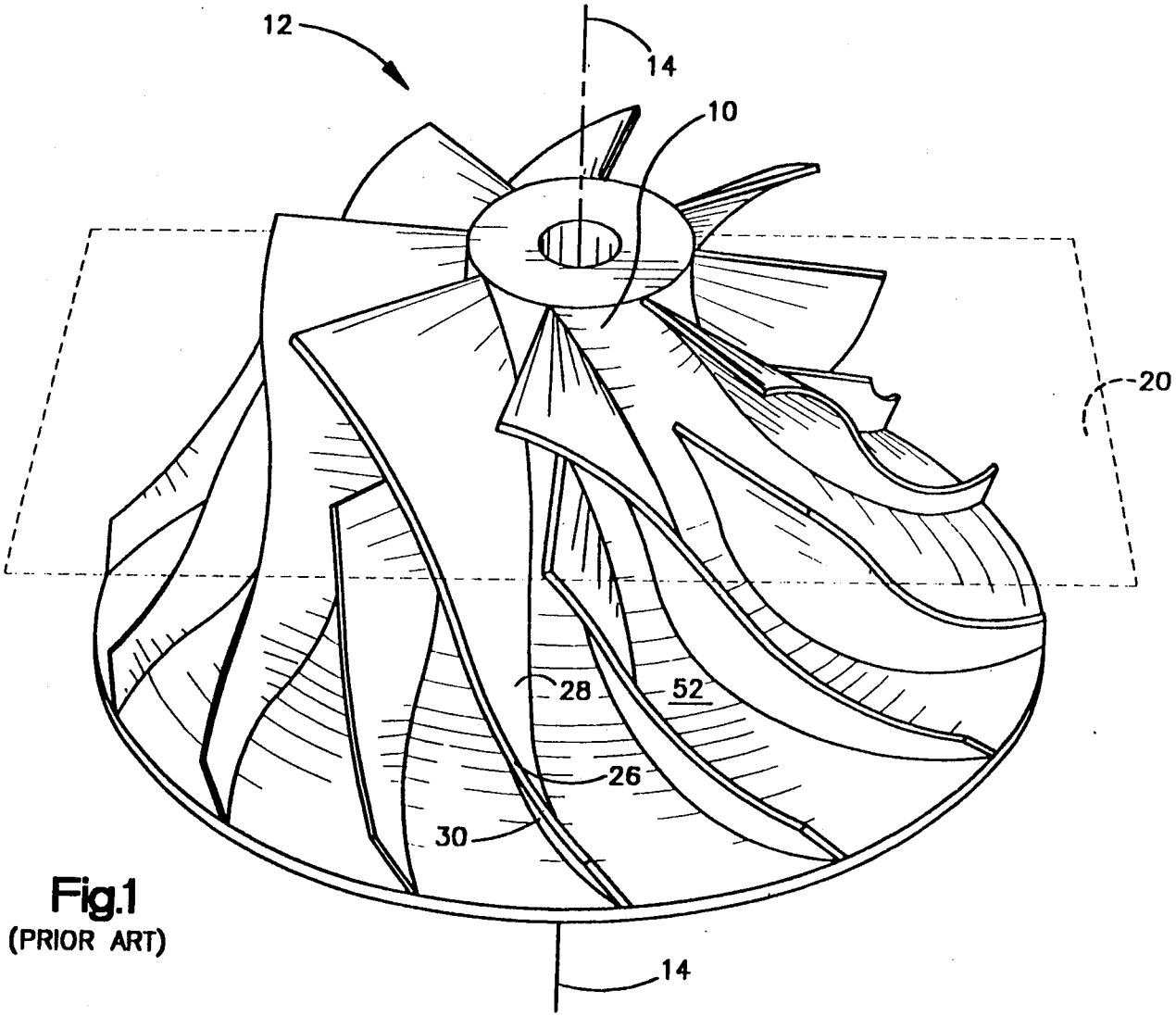
Fig.1 (PRIOR ART)
FIG. 1 is a perspective top and side view illustrating a prior art embodiment of a centrifugal impeller, showing a plane which is normal to the axis of rotation of the impeller that identifies a cross-sectional view of the impeller.

In this specification, identical elements in different embodiments are given identical reference characters.

This invention relates to the contour of a hub 10 for a centrifugal impeller 12. The hub and the impeller are concentrically formed and rotate about an axis of rotation 14.

A plurality of substantially radially extending blades 26 are affixed to the hub 10 of the centrifugal impeller 12. Each blade has a first or suction side 28 and a second or pressure side 30 with a distinct portion of the hub being located between the first side 2 and the second side 30. The impeller rotates about the axis of rotation in the direction of rotation 31. A transition fillet 32 may be located between hub 10 and the sides 28, 30.

For a given point on the axis of rotation 14, only a single plane 20 can be generated which is normal to the axis of rotation. Two concentric circles 22 and 22' can be generated, in the plane, about the axis of rotation. In prior art centrifugal impellers (see FIG. 2), the hub contour 23 closely corresponds to a concentric circle 22.

Whether a hub profile is arbitrary can be determined as follows. For each plane, the concentric circle 22 (FIG. 2 and 3) is drawn to intersect a point 33' on the hub 10 which is closest to the axis of rotation 14. The second concentric circle 22' is drawn with a radius being greater than the first concentric circle 22 by a distance equal to five percent of the height 25 of a blade 26 taken in the radial direction.

Figure 2:
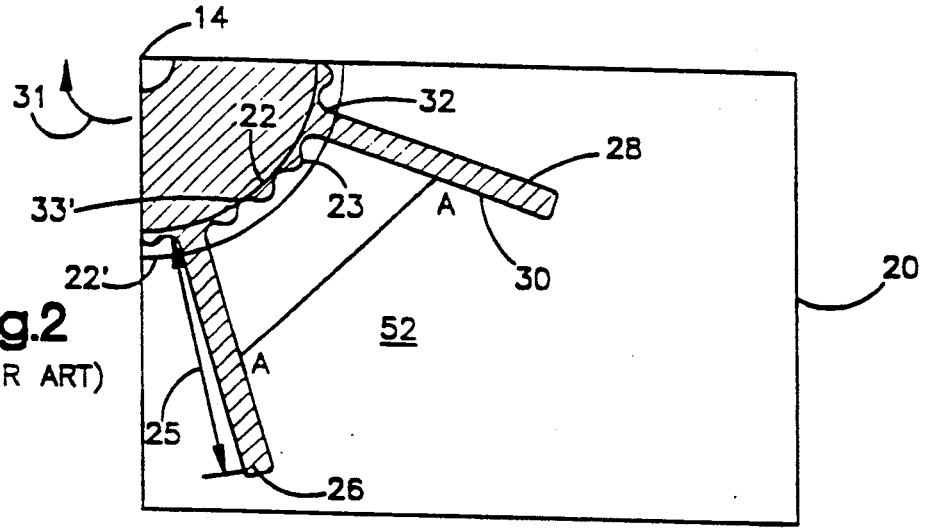
Fig.2 (PRIOR ART)
FIG. 2 is the cross-sectional view of one quadrant of the impeller, identified by the plane in FIG. 1.

If a portion of the hub does not extend outside of the second concentric circle 22', then the hub is concentric or non arbitrary (as illustrated in FIG. 2). If a portion of the hub 24 extends outside of the second concentric circle 22' (as in FIG. 3), then the hub is considered arbitrary or non concentric.

Figure 3:
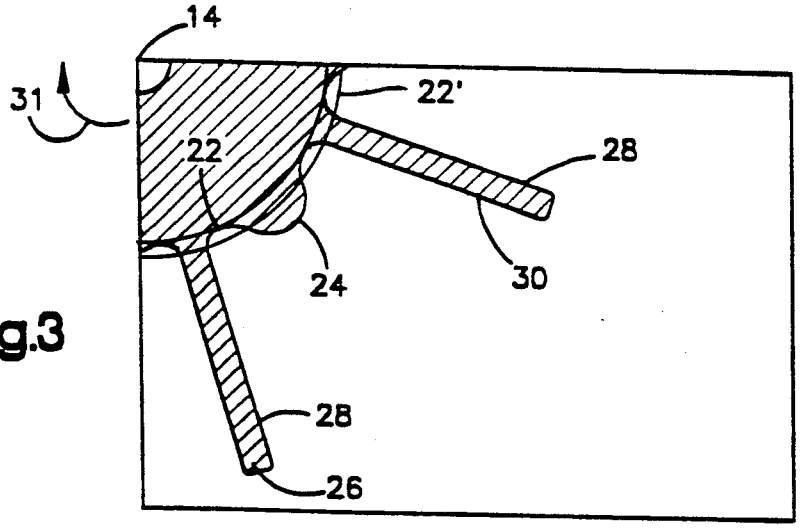
FIG. 3 is a cross-sectional view, similar to FIG. 2, of one embodiment of an arbitrary hub of the instant invention.

The curved surface of the hub profile 24 shown in cross-section in FIG. 3 is continuous, i.e., no sharp angle is shown to create a discontinuous surface. Such is also shown in FIG. 4, which shows in cross-section, the continuously curved surface of the hub.

Figure 4:
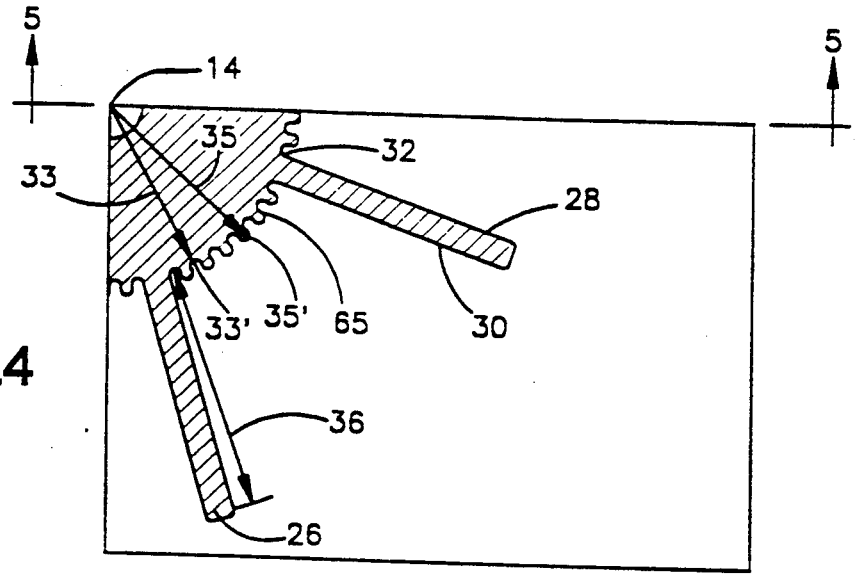
FIG. 4 is a cross-sectional view, similar to FIG. 2, of an alternate embodiment of an arbitrary hub of the instant invention.

An alternate method to determine an arbitrary hub profile for a given plane 20 follows (see FIG. 4). A first ray 33 extends from the axis of rotation 14 to a first point 33', which is the point on the hub which is closest to the axis of rotation. A second ray 35 extends from the axis of rotation 14 to a second point 35', which is the point on the hub 10 which is furthest from the axis of rotation.

For a hub profile to be considered arbitrary, the difference in length between the first ray 33 and the second ray 35 must exceed 5 percent of the total height 36 (measured radially) of the blade 26. No point located within the transition fillets 32, or sides of the blades 28, 30 are to be considered in determining whether a surface is arbitrary.

A certain impeller with an arbitrary hub design may have a series of planes having arbitrary hub profiles while another series of planes in the same impeller do not have an arbitrary profile. Alternately, the specific profile of the arbitrariness, or the purpose for the arbitrariness, may be altered from plane to plane within the impeller 12.

The arbitrariness of a hub surface may be similarly defined by an imaginary plane normal to the primary flow direction, as it has been defined above by an imaginary plane normal to the axis of rotation.

Even though the sides 28, 30 are curved surfaces, often they can be generated with a flank 42 of a miller 34 since the curve which forms the sides may be formed from a series of straight lines, (as described in U.S. Pat. No. 5,014,421, issued May 14, 1991, incorporated herein by reference).

Figure 5:
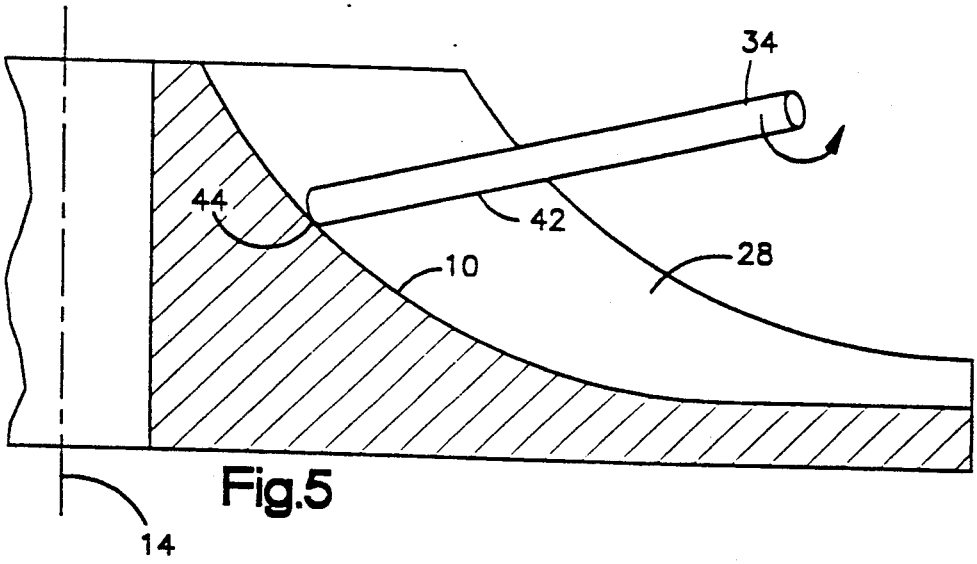
FIG. 5 is a cross-sectional view taken along sectional line 5—5 of FIG. 4 during the milling of the impeller.
Figure 6:
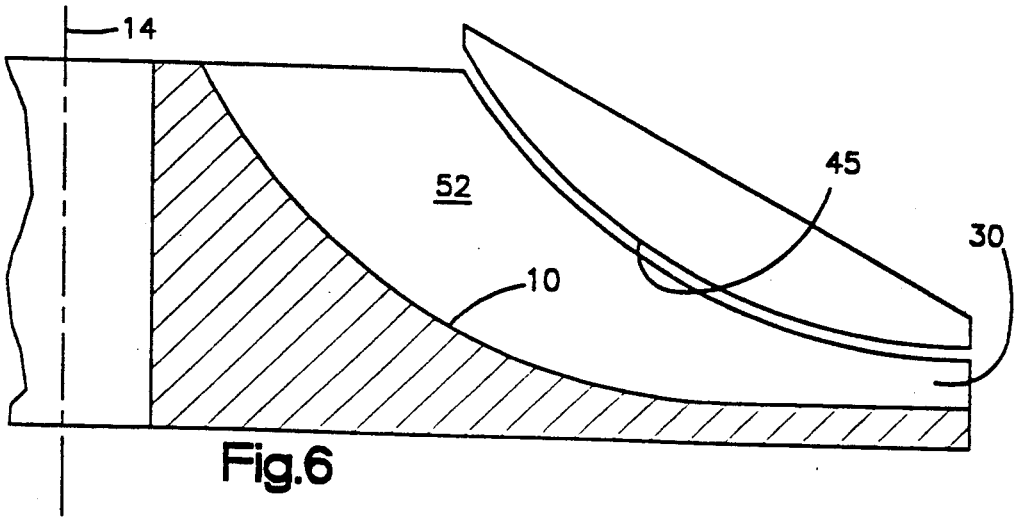
FIG. 6 is a cross-sectional view, similar to FIG. 5, after milling, showing a stationary (i.e., nonrotating) shroud in its proper location.
Figure 7:
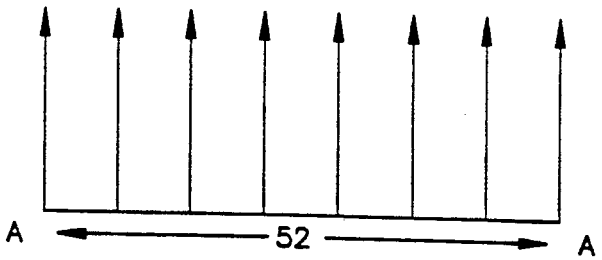
FIG. 7 is a diagram illustrating fluid flow velocities along line A—A of FIG. 2 for an ideal centrifugal impeller with no surface friction.

When a flank 42 of the miller 34 is shaping the sides 28, 30, a point 44 of the miller 34 is forming a portion of the hub 10 as shown in FIG. 5. Often the entire hub 10 is formed by point milling. In the prior art the hub has scalloped surfaces 23 after machining (see FIG. 2). An arbitrary surface pertains to a much greater surface irregularity than that of a scalloped surface.

Since a curved surface takes approximately the same time to machine by point milling as a flat surface, an arbitrary hub surface (being curved as desired by the impeller designer) as illustrated in FIGS. 3 and 4 may be machined with a point miller nearly as efficiently as a concentric surface.

While the above discussion about the arbitrary hub profile pertains to machining the impeller by milling techniques, it is also understood that there are equally significant advantages to a cast impeller having a arbitrary hub surface. Further, impellers with arbitrary hub surfaces may be cast as easily as the prior art impellers.

Arbitrary hub profiles have improved flow characteristics in centrifugal impellers as follows. A specific arbitrary hub surface may have different effects on impeller efficiencies based upon the RPM of the impeller, the specific characteristics of the fluid being pumped or compressed, and the specific blade geometry of the impeller.

There are only four surfaces in the centrifugal impeller 12 which are in direct contact with the working fluid, and which therefore may affect fluid flow characteristics. These surfaces are the suction side 28 of the blade, the pressure side 30 of the blade, the hub 10 and the shroud 45. These four surfaces 28, 30, 10 and 45 form a passage 52 through which fluid passes as it traverses the impeller.

The shroud 45 forms the fourth side of the passage which restricts fluid flow within the passage along with the two blades and the hub 10. The shroud may be stationary and separate from the impeller or may be attached to and rotate with the impeller. The shroud 45, if it is attached, may be formed in an arbitrary design to produce results similar to that of the hub.

There are several reasons why arbitrary hub profiles may be desired over concentric hub profiles. The ideal flow characteristics for the centrifugal impeller, as taken along line A—A of FIG. 2 (into the paper) where flow velocities adjacent the wall 28 are identical to the flow velocities in the center of the passage 52.

Figure 8:
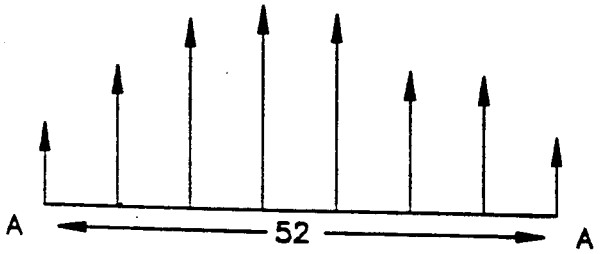
Fig.8 (PRIOR ART)
FIG. 8 is a view similar to FIG. 7 for the actual prior art centrifugal impeller of FIGS. 1 and 2 when surface friction is taken into account.

The actual flow characteristics produced by centrifugal impellers 12 having concentric hub surfaces, are illustrated in FIG. 8 in which the velocities near the center of the passage 52 exceed the velocities of the fluid near the blades due to skin friction and turbulence. These flow irregularities make the impeller less efficient and restrict the operating range at which the impeller exhibits stable flow characteristics.

Figure 9:
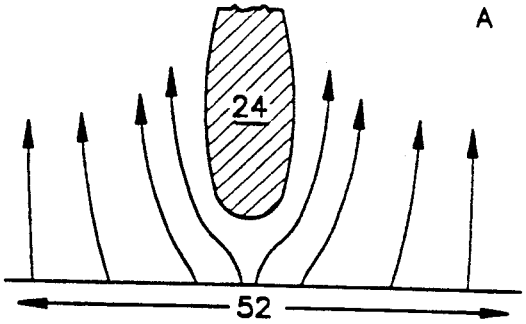
FIG. 9 is a view similar to FIG. 7 for the impeller of the present invention as illustrated in FIG. 3.

To equalize the flow velocities across the width of the passage, an arbitrary hub profile 24 illustrated in FIG. 3 is contoured wherein fluid entering the center of passage 52 will tend to be diverted to either wall. The resultant velocity profile of fluid passing through this passage is illustrated in FIG. 9 which is closer to the ideal velocity profile than the prior art centrifugal impellers.

As illustrated in FIG. 4, an alternate arbitrary hub configuration involves channels 65 which extend in a meridional direction (into the page). These channels resist the tendency of fluid passing through passage 52 to flow across the passage. Cross flow tends to create turbulence which will decrease the efficiency of the impeller as well as limit the range at which the impeller will operate stably.

Figure 10:
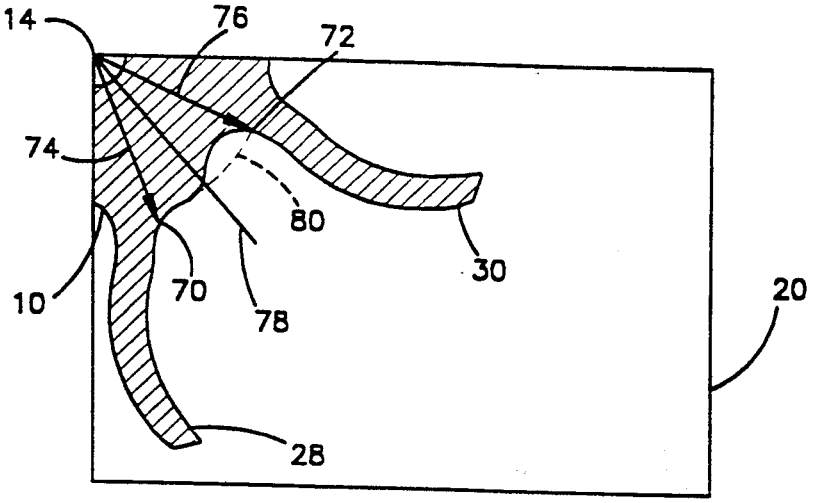
FIG. 10 is a cross-sectional view, similar to FIG. 2, of a non reflexive arbitrary hub of the instant invention.

A third reason for forming an arbitrary hub involves structural considerations as illustrated in FIG. 10. When the impellers are exposed to high rotational velocities about the axis of rotation 14, an unacceptable stress may be placed upon the blades or the hub. This stress may be increased in those designs where the shroud 45 rotates with the impeller. To reduce this stress, the hub may be built up by an arbitrary contour at a location where the flow characteristics are not critical.

For whatever reason the hub surface is being formed in an arbitrary manner, since the hub is usually produced using either point milling or casting, the time required to produce the parts should not be increased considerably.

An arbitrary hub 10 configuration results in the possibility that the hub will not be reflexive, which may be determined as follows (see FIG. 10). A suction intersection 70 is the point, in the surface 20, where the suction plane 28 intersects the hub 10. A pressure intersection 72 is the point where the pressure surface 30, of an adjacent blade, intersects the hub 10. Fillets are not considered in determining the intersection points.

A first ray 74 is constructed from the axis of rotation 14 to the suction intersection 70. A second ray 76 is constructed from the axis of rotation to the pressure intersection 72. A third ray 78 is constructed to bisect the angle between the first ray and the second ray.

A mirror image 80 of the hub between the third ray and the first ray is produced between the third ray and the second ray. If the hub is reflexive or concentric, the mirror image will approximate the hub between the third ray and the second ray.

If, however, the hub is non reflexive and arbitrary as indicated in the FIG. 10, the hub 10 between the third and the second ray will not match the mirror image. This configuration demonstrate the freedom which a designer has in alternate arbitrary hub configurations.

While the above describe reasons for arbitrary hub configuration, it is within the intended scope of the present invention to provide arbitrary surfaces, for whatever reason.

Having described the invention, what is claimed is:

1. A centrifugal impeller comprising:

a hub having an axis of rotation;

a plurality of substantially radially extending blades affixed to the hub, each blade having a height being measured in a radial direction from the hub, each blade having a suction surface, a pressure surface being formed on an adjacent blade facing the suction surface;

a blade suction surface, the adjacent blade pressure surface and the hub forming a flow passage; and the hub having an arbitrary configuration defined by first and second concentric circles formed in an imaginary plane, the imaginary plane extending in a direction normal to the axis of rotation, the centers of the concentric circles being the axis of rotation, the first circle passing through a point on the hub located closest to the axis of rotation, the second circle having a radius greater than the first circle by an amount equal to five percent of said blade height, at least a portion of the hub extending outside the second circle and with the cross section of the hub in the plane having a continuous curved shape, the portion of the hub surface between a pair of adjacent blades being asymmetric relative to a point located midway between the pair of blades.

2. The centrifugal impeller of claim 1 wherein the hub extends outside the second circle between the midpoint and one blade and does not extend outside the second circle between the midpoint and the other blade.

3. A centrifugal impeller comprising:

a hub having an axis of rotation;

a plurality of substantially radially extending blades affixed to the hub, each blade having a height being measured in a radial direction from the hub, each blade having a suction surface, a pressure surface being formed on an adjacent blade facing the suction surface;

a blade suction surface, the adjacent blade pressure surface and the hub forming a flow passage; and the hub having an arbitrary configuration defined by first and second concentric circles formed in an imaginary plane, the imaginary plane extending in a direction normal to the axis of rotation, the centers of the concentric circles being the axis of rotation, the first circle passing through a point on the hub located closest to the axis of rotation, the second circle having a radius greater than the first circle by an equal to five percent of said blade height, at least a portion of the hub extending outside the second circle and with the cross section of the hub in the plane having a continuous curved shape, the arbitrary hub configuration equalizing the flow velocities across a width of the flow passage.

4. A centrifugal impeller comprising:

a hub having an axis of rotation;

a plurality of substantially radially extending blades affixed to the hub, each blade having a height being measured in a radial direction from the hub, each blade having a suction surface, a pressure surface being formed on an adjacent blade facing the suction surface;

a blade suction surface, the adjacent blade pressure surface and the hub forming a flow passage; and the hub having an arbitrary configuration defined by first and second concentric circles formed in an imaginary plane, the imaginary plane extending in a direction normal to the axis of rotation, the centers of the concentric circles being the axis of rotation, the first circle passing through a point on the hub located closest to the axis of rotation, the second circle having a radius greater than the first circle by an equal to five percent of said blade height, at least a portion of the hub extending outside the second circle and with the cross section of the hub in the plane having a continuous curved shape, the hub surface between a pair of adjacent blades being non-reflexive.

5. A centrifugal radial flow impeller comprising:

a hub having a hub configuration formed about an axis of rotation;

a plurality of substantially radially extending blades which are affixed to the hub, the blades having a height being measured in a radial direction from the hub, each blade having a suction surface, a pressure surface being formed on an adjacent blade facing the suction surface;

a blade suction surface, the adjacent blade pressure surface and the hub forming a flow passage; and the hub configuration having an arbitrary configuration defined by a first ray coincident with an imaginary plane, the imaginary plane extending in a direction normal to the axis of rotation, the first ray extending from the axis of rotation to a first point, the first point being a point on the hub configuration closest to the axis of rotation; a second ray, coincident with the imaginary plane, extending from the axis of rotation to a second point, the second point being a point on the hub configuration furthest from the axis of rotation, the difference in length between the first ray and the second ray being greater than 5 percent of the blade height, and the cross section of the hub in the plane having a continuous curved shape, the arbitrary hub configuration equalizing the flow velocities across a width of the flow passage.

6. A centrifugal radial flow impeller comprising:

a hub having a hub configuration formed about an axis of rotation;

a plurality of substantially radially extending blades which are affixed to the hub, the blades having a height being measured in a radial direction from the hub, each blade having a suction surface, a pressure surface being formed on an adjacent blade facing the suction surface;

a blade suction surface, the adjacent blade pressure surface and the hub forming a flow passage; and the hub configuration having an arbitrary surface defined by a first ray coincident with an imaginary plane, the imaginary plane extending in a direction normal to the axis of rotation, the first ray extending from the axis of rotation to a first point, the first point being a point on the hub configuration furthest from the axis of rotation, a second ray, coincident with the imaginary plane, extending from the axis of rotation to a second point, the second point being a point on the hub configuration furthest from the axis of rotation, the difference in length between the first ray and the second ray being greater than 5 percent of the blade height, and the cross section of the hub in the plane having a continuous curved shape, the hub surface between a pair of adjacent blades being non-reflexive.

7. A centrifugal radial flow impeller comprising:

a hub having an axis of rotation;

a plurality of substantially radially extending blades affixed to the hub, the blades having a height being measured in a radial direction from the hub, each blade having a suction surface, a pressure surface being formed on an adjacent blade facing the suction surface;

a blade suction surface, the adjacent blade pressure surface and the hub forming a flow passage; and the hub having an arbitrary configuration defined by first and second concentric circles formed in an imaginary plane, the imaginary plane extending in a direction normal to the axis of rotation, the centers of the concentric circles being the axis of rotation, the first circle passing through a point on the hub located closest to the axis of rotation, the second circle having a radius greater than the first circle by an equal to five percent of said blade height, at least a portion of the hub extending outside the second circle and with the cross section of the hub in the plane having a continuous curved shape, the portion of the hub surface between a pair of adjacent blades being asymmetric relative to a point located midway between the pair of blades.

8. A centrifugal radial flow impeller comprising:

a hub having an axis of rotation;

a plurality of substantially radially extending blades affixed to the hub, the blades having a height being measured in a radial direction from the hub, each blade having a suction surface, a pressure surface being formed on an adjacent blade facing the suction surface;

a blade suction surface, the adjacent blade pressure surface and the hub forming a flow passage; and the hub having an arbitrary configuration defined by first and second concentric circles formed in an imaginary plane, the imaginary plane extending in a direction normal to the axis of rotation, the centers of the concentric circles being the axis of rotation, the first circle passing through a point on the hub located closest to the axis of rotation, the second circle having a radius greater than the first circle by an equal to five percent of said blade height, at least a portion of the hub extending outside the second circle and with the cross section of the hub in the plane having a continuous curved shape, the arbitrary hub configuration equalizing the flow velocities across a width of the flow passage.

9. A centrifugal radial flow impeller comprising:

a hub having an axis of rotation;

a plurality of substantially radially extending blades affixed to the hub, the blades having a height being measured in a radial direction from the hub, each blade having a suction surface, a pressure surface being formed on an adjacent blade facing the suction surface;

a blade suction surface, the adjacent blade pressure surface and the hub forming a flow passage; and the hub having an arbitrary configuration defined by first and second concentric circles formed in an imaginary plane, the imaginary plane extending in a direction normal to the axis of rotation, the centers of the concentric circles being the axis of rotation, the first circle passing through a point on the hub located closest to the axis of rotation, the second circle having a radius greater than the first circle by an equal to five percent of said blade height, at least a portion of the hub extending outside the second circle and with the cross section of the hub in the plane having a continuous curved shape, the hub surface between a pair of adjacent blades being non-reflexive.

* * * * *

UNITED STATES PATENT AND TRADEMARK OFFICE

CERTIFICATE OF CORRECTION

PATENT NO. : 5,215,439

DATED : 06/01/93

INVENTOR(S) : Willem Jansen and Melvin Platt

It is certified that error appears in the above—identified patent and that said Letters Patent is hereby corrected as shown below:

In Claim 3, column 5, line 53, of the Patent, after "an", insert --amount--

In Claim 4, column 6, line 9, of the Patent, after "an", insert --amount--

In Claim 5, column 6, lines 26-27, of the Patent, delete "configuration" and replace with --surface--

In Claim 7, column 7, line 6, of the Patent, delete "the blades" and replace with --each blade--

In Claim 7, column 7, line 22, of the Patent, after "an", insert --amount--

In Claim 8, column 7, line 33, of the Patent, delete "the blades" and replace with --each blade--

In Claim 8, column 8, line 9, of the Patent, after "an", insert --amount--

In Claim 9, column 8, line 18, of the Patent, delete "the blades" and replace with --each blade--

UNITED STATES PATENT AND TRADEMARK OFFICE

CERTIFICATE OF CORRECTION

PATENT NO. : 5,215,439

DATED : 06/01/93

INVENTOR(S) : Willem Jansen and Melvin Platt

It is certified that error appears in the above-indentified patent and that said Letters Patent is hereby corrected as shown below:

In Claim 9, column 8, line 33, after "an: insert --amount--

Signed and Sealed this

Twenty-fifth Day of January, 1994

*Attest:*

Bruce Lehman

BRUCE LEHMAN

*Attesting Officer*

*Commissioner of Patents and Trademarks*